US009970726B1

(12) United States Patent
Hubert et al.

(10) Patent No.: US 9,970,726 B1
(45) Date of Patent: May 15, 2018

(54) MANUAL TACTICAL SAFETY SYSTEM FOR GLOCK PISTOL

(71) Applicant: R.D.I.H. SPRL, Liège (BE)

(72) Inventors: Leon Hubert, Liège (BE); Robert Hubert, Cheratte (BE)

(73) Assignee: R.D.I.H. SPRL, Liège (BE)

( * ) Notice: Subject to any disclaimer, the term of this patent is extended or adjusted under 35 U.S.C. 154(b) by 0 days. days.

(21) Appl. No.: 15/490,203

(22) Filed: Apr. 18, 2017

(51) Int. Cl.

| | |
|---|---|
| ***F41A 17/00*** | (2006.01) |
| ***F41A 17/64*** | (2006.01) |
| ***F41A 17/02*** | (2006.01) |
| ***F41C 3/00*** | (2006.01) |
| ***F41A 11/00*** | (2006.01) |

(52) U.S. Cl.
CPC ..... *F41A 17/64* (2013.01); *F41A 11/00* (2013.01); *F41A 17/02* (2013.01); *F41C 3/00* (2013.01)

(58) Field of Classification Search
CPC ..... F41A 17/72; F41A 17/42; F41A 17/74; F41A 17/06; F41A 17/08
USPC ..... 42/70.01–70.08; 89/142, 148, 150, 154, 89/27.12
See application file for complete search history.

(56) References Cited

U.S. PATENT DOCUMENTS

| | | | | |
|---|---|---|---|---|
| 4,312,263 | A * | 1/1982 | Bourlet | F41A 17/72 89/154 |
| 4,461,110 | A * | 7/1984 | Inderbitzen | F41A 17/74 42/66 |
| 4,628,626 | A * | 12/1986 | Brandt | F41A 17/74 42/70.01 |
| 4,926,575 | A * | 5/1990 | Pastor | F41A 17/46 42/70.06 |

(Continued)

*Primary Examiner* — Michael D David
(74) *Attorney, Agent, or Firm* — Reinhart Boerner Van Deuren P.C.

(57) ABSTRACT

A removable manual and tactical safety device (1) for a hammerless or linear striker fired firearm, comprising a cylindrical body (2) having a longitudinal recess (3), a first lever (4) and a second lever (5) being secured together according to the axis of said longitudinal recess (3), said cylindrical body (2) having a transverse housing (9) for lodging a push pin (10) comprising a cogwheel having at least two cut cogs (14A) defining at least a first position and a second position of the push pin (10) respectively, said first lever (4) having a body (6) provided on its external surface with at least two pinions teeth (14B) capable of cooperating with the cut cogs (14A), so that the rotating of the first lever (4) secured with the second lever (5) permits the displacement of the push pin (10) perpendicularly to the axis of the longitudinal recess (3), said push pin (10) being held in said first and second position respectively by a spring (11) cooperating with a pin (12) located in a longitudinal cavity (13) of the cylindrical body (2) parallel to the axis of the longitudinal recess (3), said spring (11) maintaining a tip of (Continued)

said pin (12) within one of two recesses (30) provided on the side of said push pin (10), said push pin (10) further having a protrusion (10A) designed so that, in use, the forward, backward respectively, displacement of the push pin (10), defining an advanced and retracted position of the push pin (10) respectively, permits to prevent, allow respectively, the connector (23) of the firearm trigger bar (15A) to release the firing pin (16) for firing.

12 Claims, 12 Drawing Sheets

(56) References Cited

U.S. PATENT DOCUMENTS 5,166,458 A * 11/1992 Yoo ..... F41A 19/45 42/69.03
5,208,406 A * 5/1993 Badali ..... F41A 17/74 42/70.08
6,539,658 B1 * 4/2003 Hubert ..... F41A 17/74 42/70.08
6,907,814 B2 * 6/2005 Spinner ..... F41A 11/00 42/70.01
6,941,692 B1 * 9/2005 Krinke ..... F41A 17/02 42/70.08
7,617,628 B2 * 11/2009 Curry ..... F41A 19/28 42/70.02
7,703,230 B2 * 4/2010 Curry ..... F41A 17/72 42/70.01
8,132,496 B2 * 3/2012 Zukowski ..... F41A 17/66 42/70.01
8,443,537 B2 * 5/2013 Curry ..... F41A 17/72 42/66
8,966,803 B2 * 3/2015 Dietel ..... F41A 17/06 42/70.01
2013/0174459 A1 * 7/2013 Moretti ..... F41A 17/60 42/69.01

* cited by examiner 11
12

13
13

9
10

1
8
2
7

MANUAL TACTICAL SAFETY SYSTEM FOR GLOCK PISTOL

FIELD OF THE INVENTION

The present invention relates to a manual and tactical safety device to be assembled on an automatic or semiautomatic firearm and which can be presented in kit form adaptable to conventional commercially available firearms. The safety device is a locking device which mandatorily requires manual release by the user independently of trigger pull.

The present invention also relates to a semiautomatic type firearm, such as a pistol, equipped with this device.

TECHNOLOGICAL BACKGROUND AND PRIOR ART

Safety mechanisms for firearms intended to prevent unintentional or inadvertent percussion are well-known. These safety mechanisms are of two types.

For firearms provided with a hammer, the safety device blocks the hammer in the cocked position ready to shoot, which nevertheless still involves risks if the weapon is dropped. In such a case, the system has the disadvantage of causing damage to the hammer and sear mechanisms or of causing the accidental firing of a bullet.

As far as hammerless firearms are concerned, these are generally not provided with manual safety, which induces a risk of unwanted shooting. In this type of weapon, the firing pin is hooked by a mechanism which, when the trigger is pressed, releases the firing pin from its cocked position and thus allows percussion. In other cases, the firing pin is in an intermediate position between the percussion position and the armed position. The stroke for fully cocking the firing pin is effected when the trigger is pressed thanks to the trigger bar. At the end of the stroke, the trigger bar is retracted and releases the firing pin. The latter, actuated by its spring, can then, by its forward movement, strike the primer of the cartridge located in the chamber. This system generally does not have manual safety mechanism and therefore also involves a risk of inadvertent firing.

AIMS OF THE INVENTION

The present invention aims to provide a rapid manual safety mechanism to be assembled on a hammerless semiautomatic firearm, such as a pistol without firearm hammer, when such a safety is not provided on the original firearm.

More particularly, the invention aims to provide such a safety mechanism provided with visualization and/or tactile marking or indexing of the firearm in the safety and ready to shoot positions respectively.

More particularly, the present invention aims to provide a safety mechanism in kit form, which is relatively easily adaptable to a particular type of weapon while retaining the conventional structure of a firearm already in service, thus without requiring any additional machining of the weapon in question or of its component parts. The kit can therefore be assembled without irreversible modification of the firearm.

Another goal of the present invention is to provide a mechanism which allows, with a single movement, to lock the firing of the weapon and likewise, with a reversed single movement, allows to release the locking without pulling the trigger, in order to prepare the firearm for firing.

An additional goal of the present invention is to provide such a safety mechanism which, in the safety position, does not block any element of the gun but prevents the trigger bar from releasing the firing pin without blocking the other parts. Therefore, this design would not involve any risk of damage, whatever the effort on the trigger.

Another aim of the present invention is to further allow the placing of a padlock preventing any shooting and thus to secure the weapon in its safe position when the gun is not used.

An additional aim of the present invention is to provide such a mechanism, which removes the requirement to press the trigger, when removing the slide, thus permitting to avoid unwanted fire when servicing the gun.

SUMMARY OF THE INVENTION

A first aspect of the present invention relates to a removable manual and tactical safety device for a hammerless or linear striker fired firearm having a frame, a slide with a slide cover plate, a trigger mechanism comprising a trigger, a trigger bar attached to the trigger and engaging by the intermediate of a connector the rear portion of a firing pin to prevent the firing pin from moving forward, the trigger bar being also capable by going down to release the firing pin for firing, when the trigger is pulled rearward, said safety device being intended to be attached at the rear of the slide and comprising a cylindrical body having a longitudinal recess, a first lever and a second lever being secured together according to the axis of said longitudinal recess, said cylindrical body having a transverse housing for lodging a push pin comprising a cogwheel having at least two cut cogs defining at least a first position and a second position of the push pin respectively, said first lever having a body provided on its external surface with at least two pinions teeth capable of cooperating with corresponding cut cogs, so that the rotating of the first lever secured with the second lever permits the displacement of the push pin perpendicularly to the axis of the longitudinal recess, said push pin being held in said first and second position respectively by a spring cooperating with a pin located in a longitudinal cavity of the cylindrical body parallel to the axis of the longitudinal recess, said spring maintaining a tip of said pin within one of two recesses provided on the side of said push pin, said push pin further having a protrusion designed so that, in use, the forward, backward respectively, displacement of the push pin, defining an advanced and retracted position of the push pin respectively, permits to prevent, allow respectively, the connector of the firearm trigger bar to release the firing pin for firing.

According to preferred embodiments, the safety device further comprises one of the following characteristics or a suitable combination of such characteristics:

- the two recesses are conical, pyramidal, spherical or in the shape a of truncated cone;
- the transverse housing for lodging the push pin and the push pin are designed so that, when the push pin is in the advanced position, the end of the push pin distal of the protrusion does not protrude at the rear of the cylindrical body and, when the push pin is in the retracted position, the end of the push pin distal of the protrusion protrudes at the rear of the cylindrical body;

- the position of the levers and of the push pin notify the user if the safety device is in a so-called "safety position", the levers being up and the push pin not protruding at the rear of the cylindrical body or a so-called "ready to shoot" position, the levers being down and the push pin protruding at the rear of the cylindrical body;

the first lever and the second lever are secured by clicking together in the longitudinal recess thanks to teeth provided in the body of the first lever each suitable to cooperate with a slot provided in the body of the second lever;

the displacement of the first lever is able to cause the displacement of the second lever;

the push pin further comprises a groove at the end opposite the protrusion and wherein the cylindrical body comprises a longitudinal boring parallel to the longitudinal recess, and traversing the transverse housing, so that a padlock can be secured in said boring when the push pin is located with the groove aligned to the boring, in safe position of the firearm.

the safety device further comprises fastening means for attaching the safety device in a sliding manner at the rear of the slide, after having removed the slide cover plate at the rear of the slide;

the safety device is intended to be placed on a firearm of the Glock type and which can be factory-assembled on said firearm or adapted to a firearm already in service.

A second aspect of the present invention relates to a firearm of the Glock type comprising a removable safety device as recited above.

Advantageously, when the safety device is located on the firearm in the safety position, the connector of the trigger bar is pushed inwardly towards the slide axis by the protrusion of the push pin which is in an advanced position, the connector being prevented in this position to contact the trigger bar and further to unlock the latter for releasing the firing pin, when the trigger is pressed by the user.

Still advantageously, when the safety device is located on the firearm in the ready to shoot position or in the firing position, the protrusion of the push pin is in a retracted rearward position, the connector being not prevented to contact the trigger bar and further to unlock the latter for releasing the firing pin, when the trigger is pressed by the user.

SHORT DESCRIPTION OF THE DRAWINGS

The present invention will be described with the appended figures representing several preferred embodiments of the invention.

FIG. 5A is the "safety position", FIG. 5B is the "ready to shoot position" and FIG. 5C is the "firing position".

FIG. 6A is the "safety position", FIG. 6B is the "ready to shoot position" and FIG. 6C is the "firing position".

FIG. 7A is the "safety position, FIG. 7B is the "ready to shoot position" and FIG. 7C is the "firing position".

NUMERICAL REFERENCES OF THE FIGURES

Figure 1:
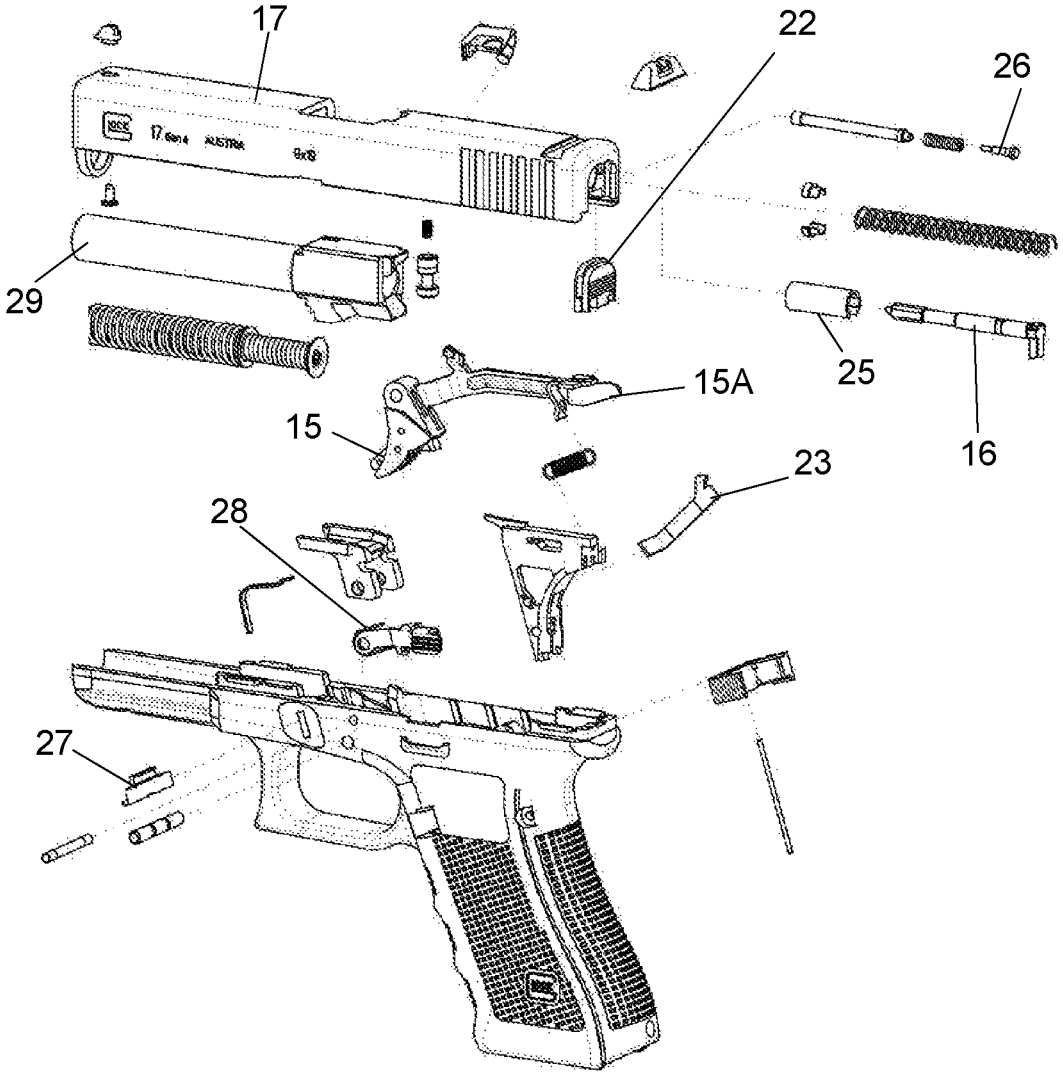
FIG. 1 is the well-known exploded perspective view with the conventional parts of a commercially-available semi-automatic pistol.

1 tactical safety device
2 cylindrical body
3 longitudinal recess
4 first lever
5 second lever
6 body of the first lever
7 teeth of the first lever
8 body of the second lever
9 housing
10 push pin
10A protruding part
11 spring
12 pin
13 boring
14A cut cogs of the cogwheel (or gear)
14B pinions teeth of the cogwheel
15 trigger
15A trigger bar
16 firing pin
17 slide
18 boring
19 groove of the push pin
20 padlock
21 fastening means
22 slide cover plate
23 connector
24 slot
25 spacer sleeve
26 spring-loaded bearing
27 slide lock
28 slide stop lever
29 barrel
30 conical recesses

DESCRIPTION OF PREFERRED EMBODIMENTS OF THE INVENTION

According to a preferred embodiment, the manual safety mechanism, hereinafter referred to as a "manual tactical safety system", may be assembled on a conventional automatic or semiautomatic firearm such as a pistol of the Glock type during manufacturing or may be presented in kit form and adapted on a weapon of this type which is already in service. The weapon modification will be very simply performed using the aforementioned kit corresponding to the respective firearm, the rest of the weapon remaining identical to the original firearm.

The safety mechanism of the invention, which is particularly simple, may thus be adapted to any hammerless semi-automatic firearm in such a manner that no modification of the firing characteristics of said firearm is needed.

For a better understanding of the operation of the device of the present invention, the exploded perspective view of FIG. 1 shows the conventional parts of a commercially-available Glock-type semi-automatic pistol. Only the parts of the firearm which are related to the operation of the device of the present invention are provided with reference numbers in FIG. 1.

Figure 2:
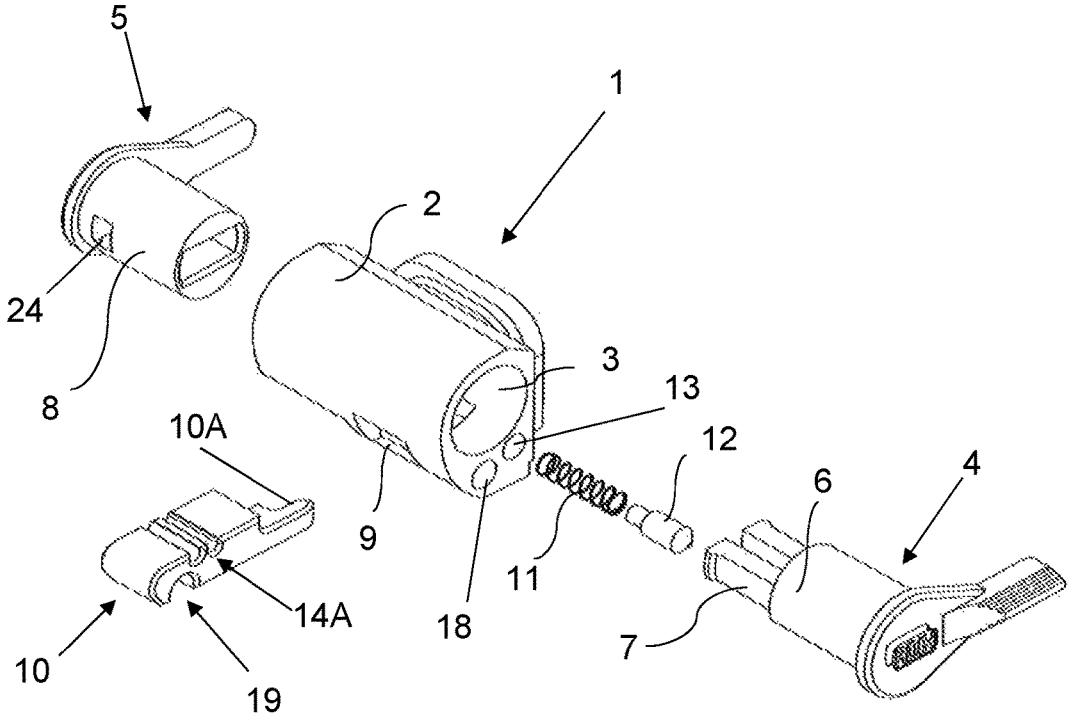
FIG. 2 is an exploded perspective view of the manual safety device according to the present invention.

FIG. 2 represents an exploded perspective view of the various parts forming the safety device intended to be assembled on a Glock-type pistol as represented in FIG. 1. The safety device 1 comprises a cylindrical body 2 having a longitudinal recess 3.

Two levers, a first lever 4 and a second lever 5, are assembled to the cylindrical body 2 and secured together by clicking them respectively within said longitudinal recess 3. In particular, the first lever 4 has a main body 6 extending with two teeth 7, and these teeth 7 are suitable to snap in a slot 24 provided in the main body 8 of the second lever 5. A push pin 10 is located in a housing 9 provided transversally in the cylindrical body 2. The push pin 10 is held in its housing 9 by a spring 11 cooperating with a pin 12. Spring 11 and pin 12 permit to locate and maintain the push pin 10 by a pressure exerted by the spring 11, the pressure being perpendicular to the axis of the push pin 10. Moreover, spring 11 and pin 12 are located in a separate cavity 13 provided in the cylindrical body 2, parallel to the longitudinal recess 3.

Figure 3A:
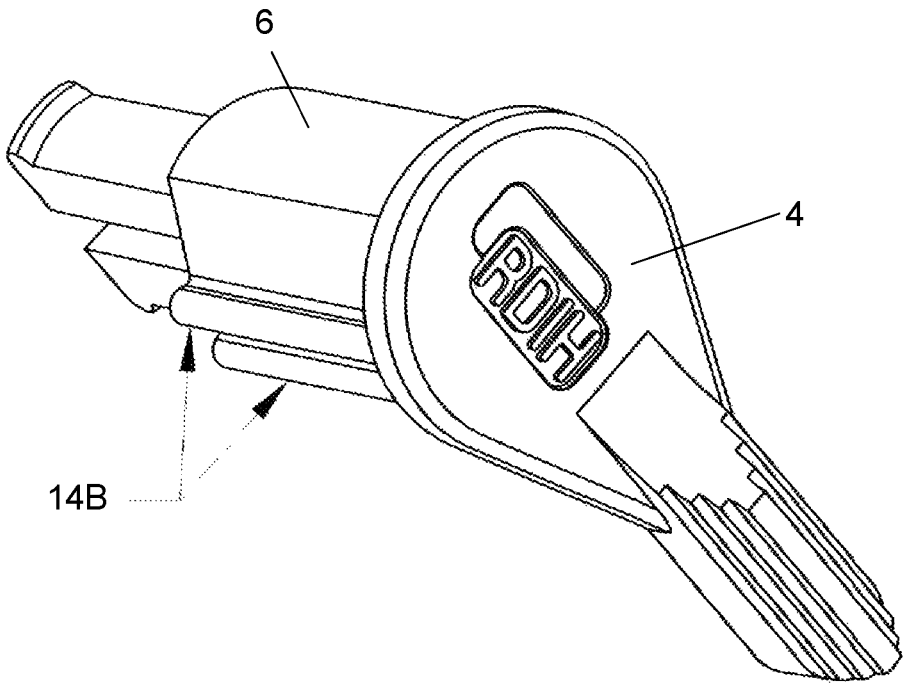
FIGS. 3A to 3E are different views showing the cogwheel mechanism of the manual safety device according to the present invention.
Figure 3B:
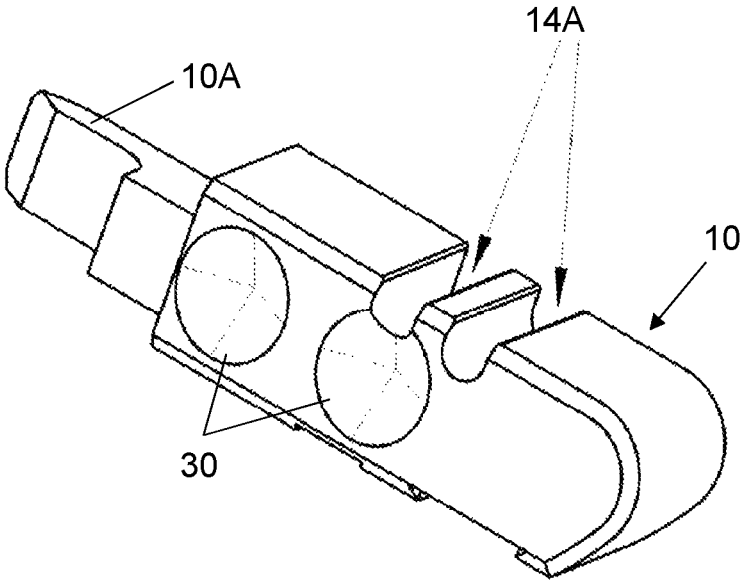
Figure 3C:
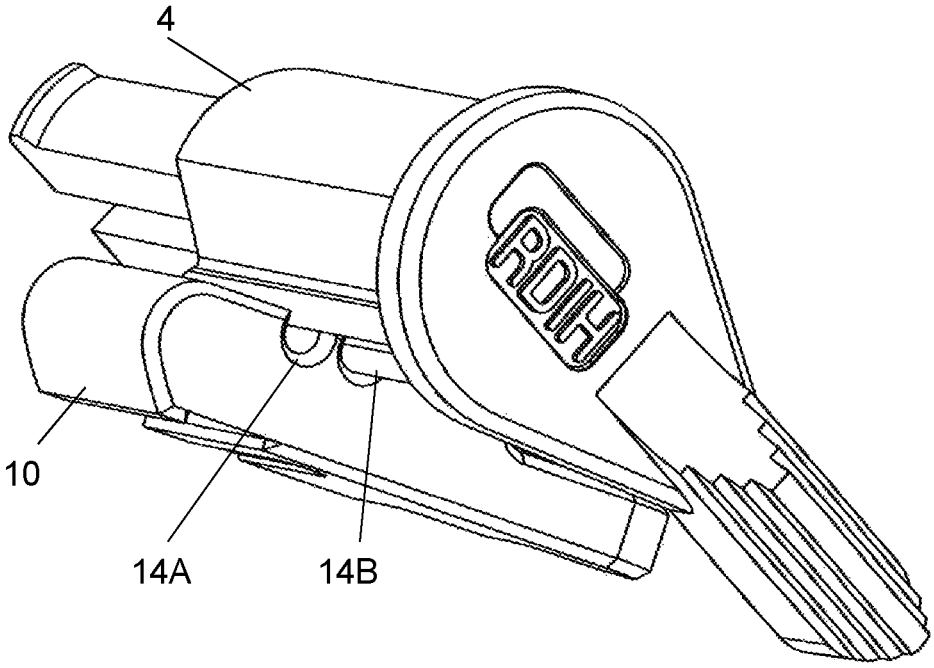
Figure 3D:
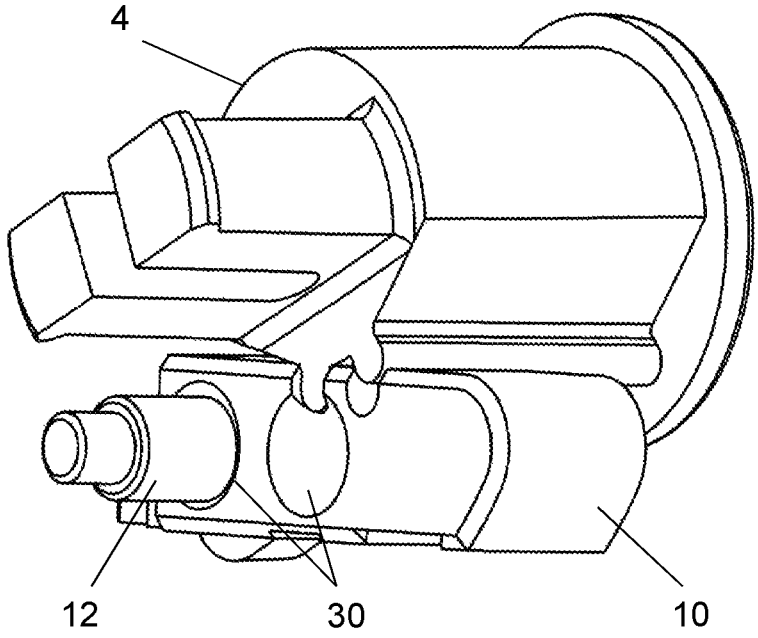
Figure 3E:
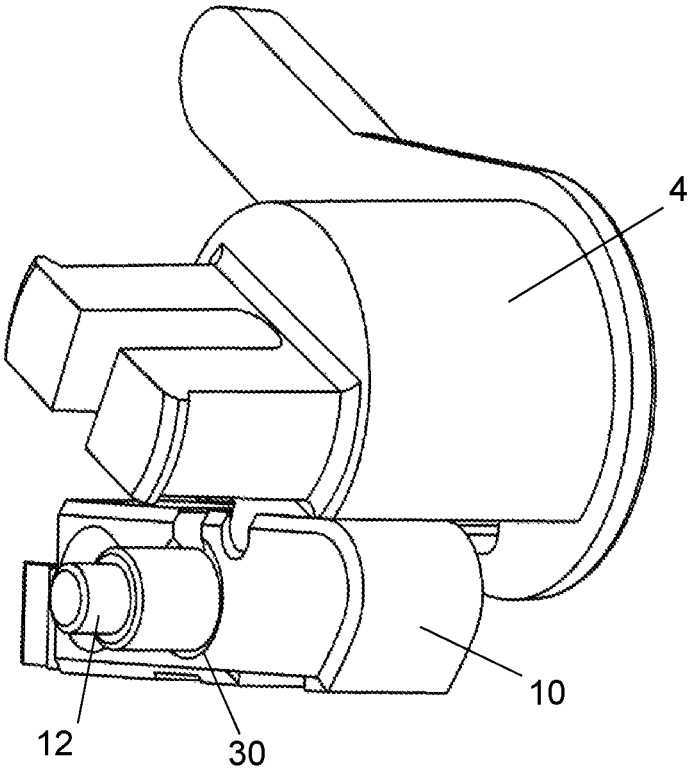

As shown on FIGS. 3A and 3B, the push pin 10 comprises two cut cogs 14A of a cogwheel while the external surface of the cylindrical body 6 of the first lever 4 comprises two pinions teeth 14B cooperating with the corresponding cut cogs 14A. Furthermore two conical recesses 30 are provided on the side of the push pin 10, each capable of lodging the tip of pin 12, thanks to the above mentioned pressure exerted by the spring 11. The two conical recesses 30 respectively correspond to the "safe" and "ready to shoot" positions of the safety device (see below). Thanks to the cogwheel, the rotation of the levers 4, 5 permits the linear displacement of the push pin 10, perpendicularly to the axis of the cylindrical body 2. The pinions teeth 14B on the first lever 4 cooperate with the cut teeth 14A on the push pin 10 to transform the rotation of the levers 4, 5 into a linear displacement of the push pin 10, the pin 12 passing then from one of the above-mentioned recesses 30 to the other one (see FIGS. 3C and 3D for the "ready to shoot" position and FIG. 3E for the "safe" position). The position, advanced or retracted, of the push pin 10 in the safety device 1, permits in use to prevent or authorize the trigger bar of the firearm to release the firing pin.

According to one embodiment, there are more than two pinions teeth 14B and more than two corresponding cut cogs 14A. A classical gear can even be contemplated.

Figure 4:
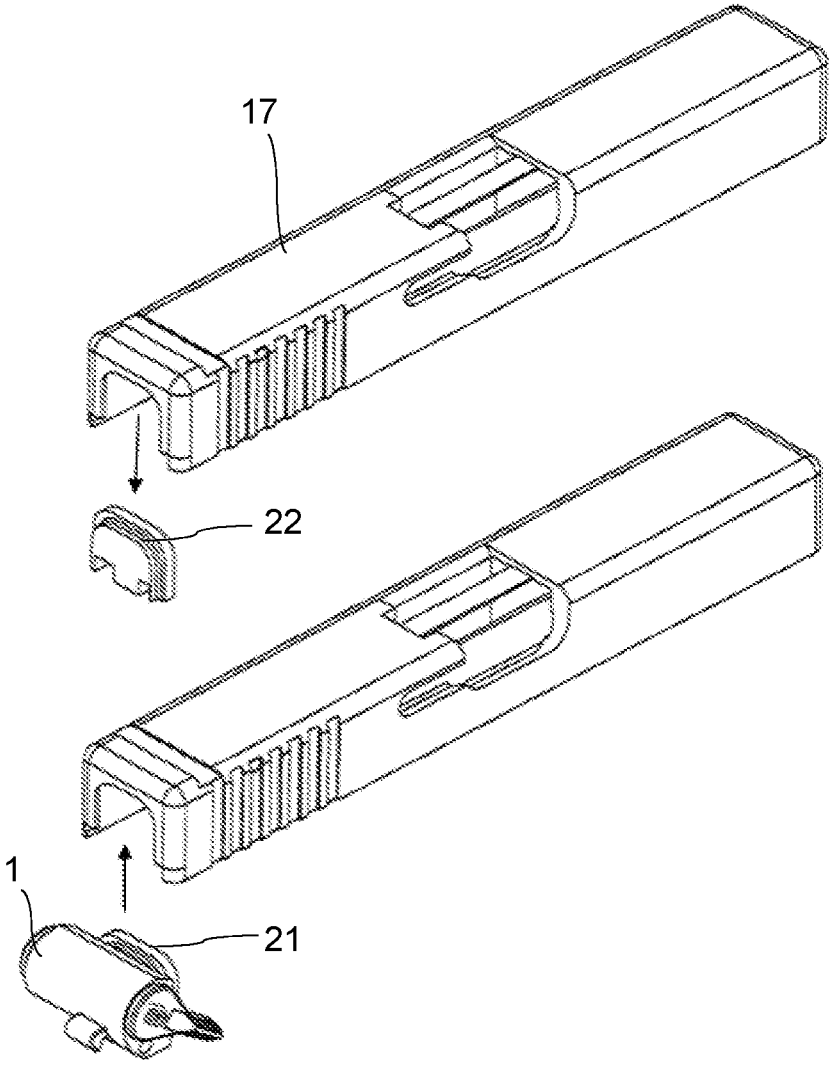
FIG. 4 is a perspective view showing the assembly of the safety device on the rear part of the firearm slide.

The safety device of the invention may be assembled easily on a firearm of the Glock type, as illustrated in FIG. 4. The safety device comprises simple fastening means 21 located on the cylindrical body 2. Firstly, the user has to remove the slide cover plate 22 of the Glock firearm, located at the back of the slide 17. Then, the user secures the safety device 1 on the rear part of the slide 17, instead of the slide cover plate 22, thanks to the fastening means 21. According to a preferred embodiment, the fastening can be effected by sliding the fastening means 21 inside the back of slide 17.

Figure 5A:
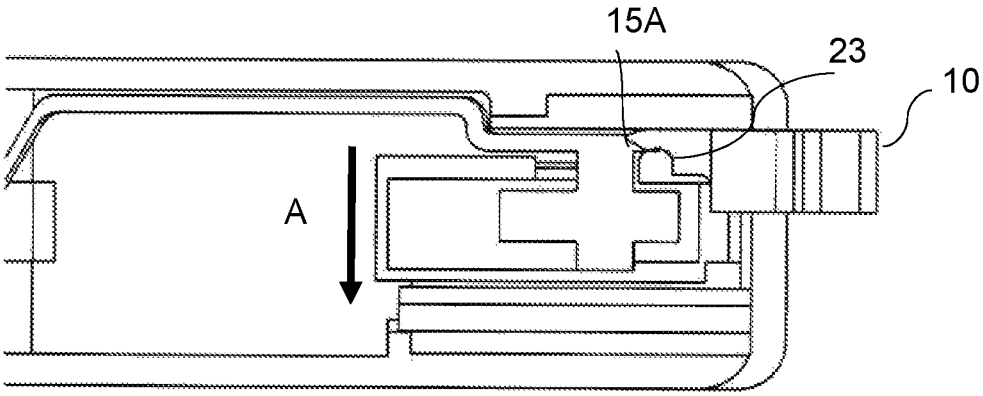
FIGS. 5A to 5C are different top views of the firing parts, showing the push pin of the safety device in different positions.
Figure 5B:
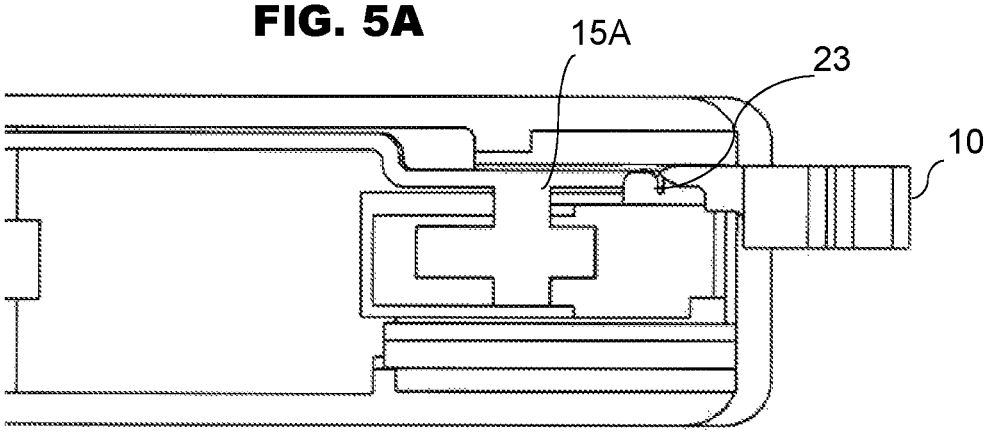
Figure 5C:
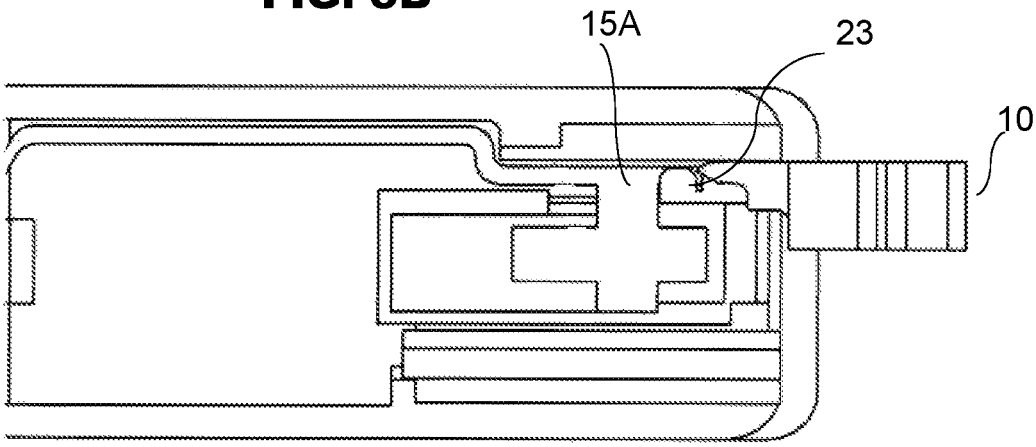
Figure 6C:
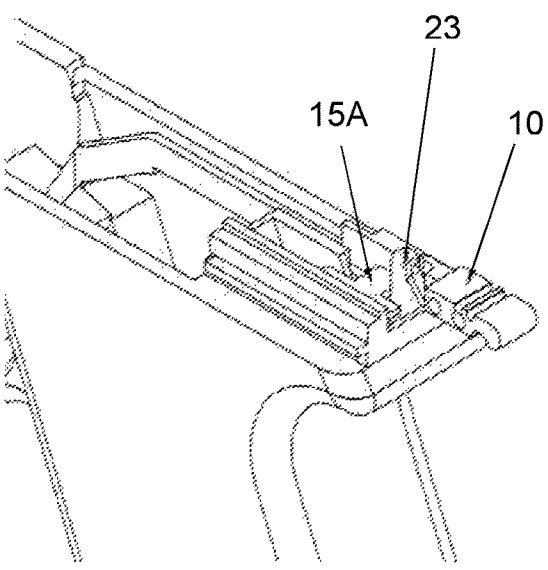
FIGS. 6A to 6C are perspective views of the firing parts showing the push pin of the safety device in different positions.
Figure 6B:
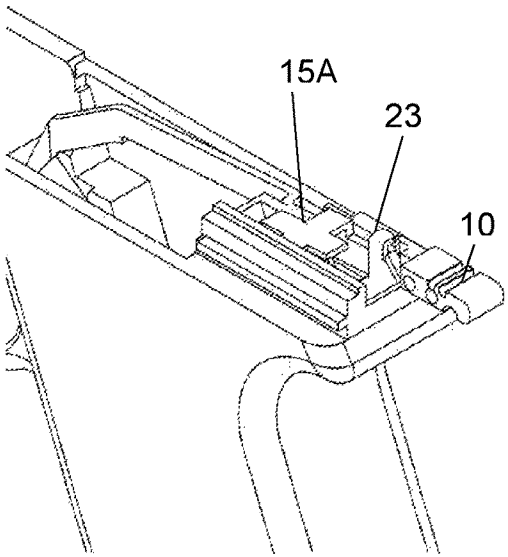
Figure 6A:
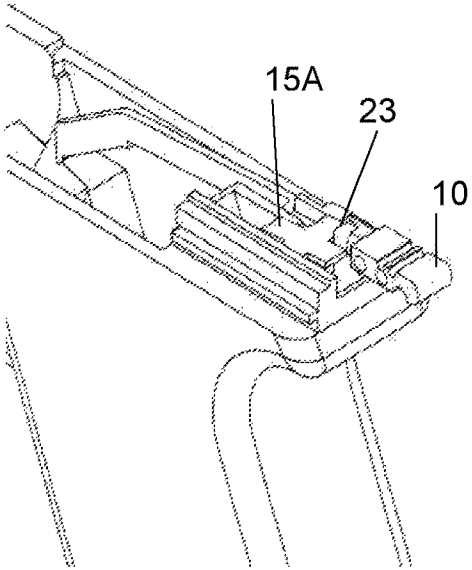
Figure 8A:
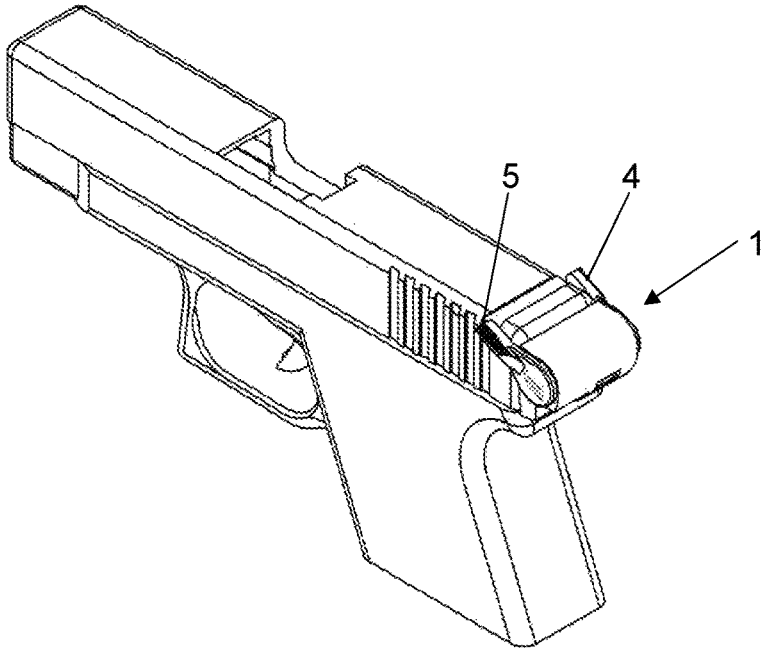
FIG. 8A is a perspective view of the assembly of the safety device on the firearm, the safety device being in the "safety position".
Figure 8B:
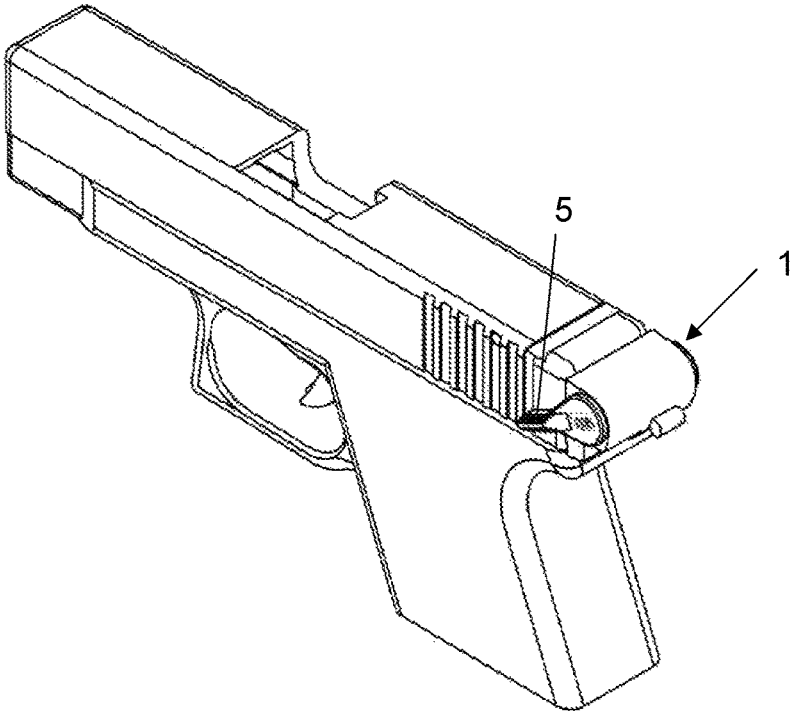
FIG. 8B is a perspective view of assembly of the safety device on the firearm, the safety device being in the "ready to shoot position".

FIGS. 5A to 5C and FIGS. 6A to 6C illustrate the operation mode of the safety mechanism, and its interaction with the firearm. In FIGS. 5A and 6A, the safety device is in a "safety position", and therefore even if the user presses the trigger, he will not be able to fire. FIGS. 5B and 6B show the "ready to shoot position". In this position the weapon is able to fire. To pass from the safety position to the ready to shoot position, the user has to rotate the first or the second lever as described above. As the two levers are interconnected, the displacement of the one causes the displacement of the other. Both positions of the levers 4, 5 are illustrated by FIGS. 8A and 8B respectively. In FIGS. 5C and 6C, the firearm is in "firing position", the levers 4, 5 are then in the same position as the "ready to shoot position". The position of the levers, lowered or lifted, visually indicates to the user if the firearm is "safe" or "ready to shoot".

On FIGS. 5A and 6A, the safety device 1 is located on the firearm in the safe position. The connector 23 of the firearm is pushed in the transverse direction (see arrow A) by the push pin 10 which is in an advanced position. Actually, the connector 23 of the firearm is pushed and displaced towards the center, and closer to the longitudinal axis of the weapon. In this position, it is impossible for the connector 23 to reach and contact the trigger bar 15A and to lower the latter. Thus, the trigger bar 15A always remains in contact with the firing pin 16 and cannot be separated from it. Consequently the firing pin 16 cannot be released. This makes the firing impossible, regardless of the trigger position. The levers 4 and 5 of the safety device are in the high position and are visible during the preparation for firing. In this position the push pin 10 does not come out at the rear of the cylindrical body 2.

On FIGS. 5B and 6B, in the "ready to shoot position", the connector movement is not influenced by the push pin 10. Indeed, when the safety device is in the "ready to shoot position", the push pin 10 is in its retracted position and is not in contact with the connector 23. In this case, the trigger bar 15A normally comes into contact with the unlocking ramp of the connector 23. The connector 23 is able to displace the trigger bar 15A, which release the firing pin 16 when the trigger 15 is pressed. The levers 4 and 5 of the safety device are downward and the push pin 10 is backward and does not influence the shoot. Its position is visible at the rear of the slide 17 and thus notifies the shooter that the weapon is ready for shooting.

On FIGS. 5C and 6C, the firearm is in firing position. The respective elements of safety device and Glock pistol firing parts are illustrated at the instant of firing.

Figure 7C:
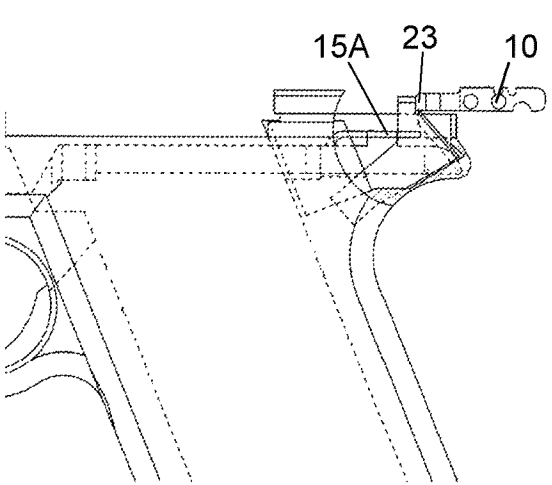
FIGS. 7A to 7C are elevation views with local cross-sectional views of the firing parts in the frame interior with the push pin of the safety device in different positions.
Figure 7B:
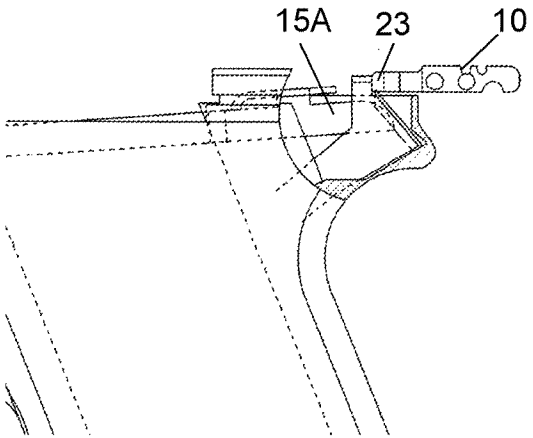
Figure 7A:
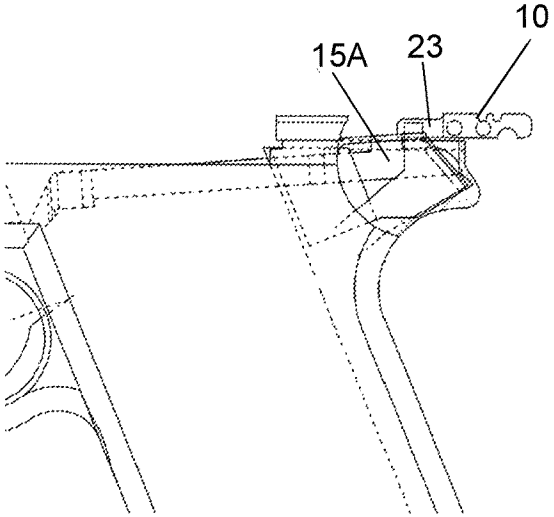

FIGS. 6A to 6C and FIGS. 7A to 7C show different views of the firing parts with the push pin of the safety device in different positions. FIGS. 6A and 7A illustrate the "safety position, FIGS. 6B and 7B illustrate the "ready to shoot position" and FIGS. 6C and 7C illustrate the "firing position" respectively.

Figures 9A, 9B, 9C, 9D, 9E:
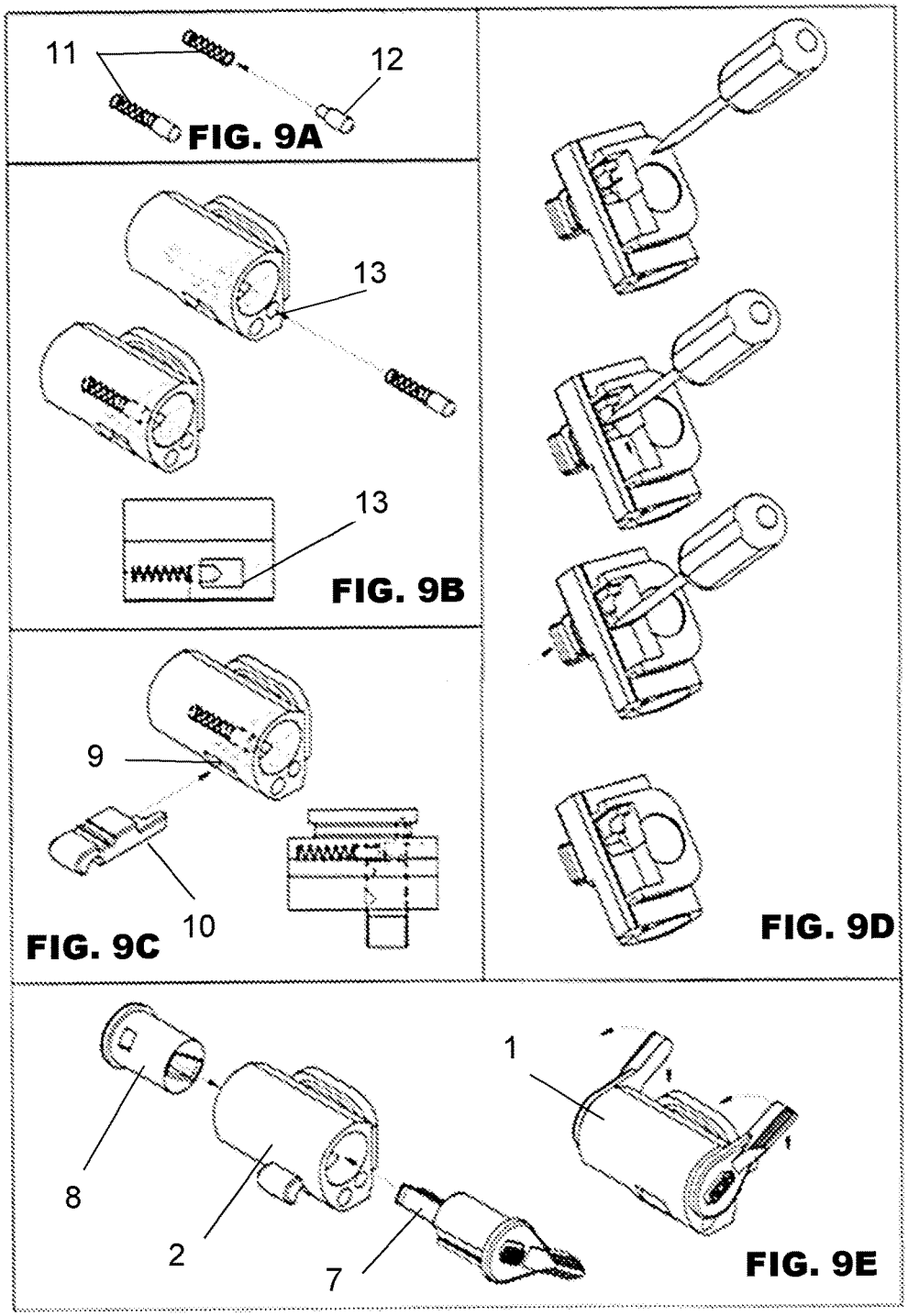
FIGS. 9A to 9E illustrate an assembly diagram of the safety device of the invention.

FIGS. 9A to 9E illustrate the assembling steps for the manual safety device 1 of the instant invention. First of all the internal pin 12 is assembled with its spring 11, as illustrated in FIG. 9A. Then said assembly is pushed within the recess 13 of the cylindrical body 2, as illustrated in FIG. 9B, and the push pin 10 is inserted into the transversal housing 9 provided in the cylindrical body, as illustrated in FIG. 9C. With the help of a tool such as a screwdriver the pin 12 is pushed against the force of the spring 11 in order to allow the tip of pin 12 to position itself in one of the conical recesses 30, as illustrated in FIG. 9D. Finally the first lever 4 and the second lever 5 are assembled by clicking within the cylindrical body 2, the teeths 7 of the first lever 4 being clipped into the body 8 of the second lever 5, as illustrated in FIG. 9E.

The assembly of the manual safety device of the present invention on a Glock-type pistol is performed as described hereinafter.

Attaching the Safety Device to the Firearm i) Place the slide 17 in rear position on the slide stop lever 28;

ii) Push the spacer sleeve 25 forward and remove the slide cover plate 22;

iii) Introduce the safety device at the entry of the slide rear end, compress forward the spacer sleeve 25 with a screwdriver and push the safety device upward up to abut against the spring-loaded bearing 26;

iv) With the screwdriver, push forward the spring-loaded bearing 26 and completely introduce the safety device until its locking, while removing the screwdriver—iii) and iv) operations can be performed at once;

v) The firearm is now provided with the manual safety device.

Disassembling of the Safety Device i) Place the slide 17 in rear position on the slide stop lever 28;

ii) Push the spacer sleeve 25 forward and remove the safety device.

Disassembling of the Slide i) Disassemble the safety device as described here above;

ii) Remove the firing pin assembly;

iii) Introduce instead of the firing pin assembly the locking tool (not shown) for the spring-loaded bearing 26 and, after compression of the latter, thanks to a counterclockwise rotation, lock the spring-loaded bearing 26;

iv) Release the slide 17 from its slide stop lever 28;

v) Push the barrel 29 rearward, lower the slide lock 27 and remove the slide 17 forward. This operation is without firing risk because the firing pin is absent whatever the position of the trigger.

Reassembling of the Slide on the Frame

Trigger being in forward position, introduce the frame into the slide 17 up to locking by the slide lock 27;

i) Place the slide 17 in rear position on the slide stop lever 28;

ii) Rotate the locking tool (not shown) for the spring-loaded bearing 26 clockwise and remove the latter from the slide 17;

iii) Perform the operations as in iii) and iv) of Attaching the safety device to the firearm;

iv) The firearm is ready to shoot.

Figure 10A:
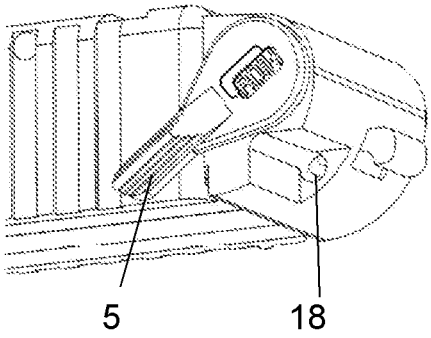
FIGS. 10A to 10B illustrate a first and second perspective view of the safety device of the invention assembled on the firearm and provided with a padlock.
Figure 10B:
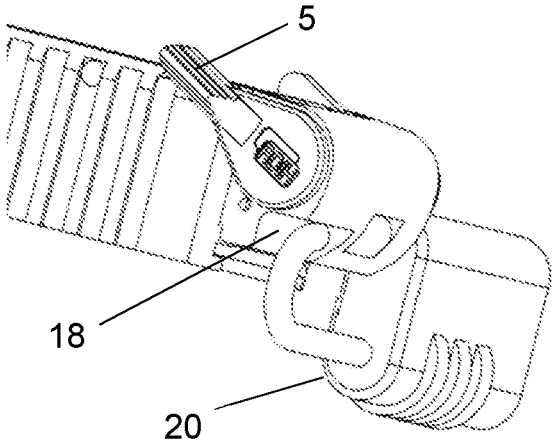

In a preferred embodiment of the invention illustrated in FIGS. 10A and 10B, a padlock 20 is provided to secure the firearm in its safe position when the firearm is not used. The cylindrical body 2 of the safety device comprises a boring 18, provided parallel to the longitudinal recess 3 and the ends of which are aligned on the housing 9 of the push pin 10. A groove 19 is provided in the push pin 10, and when the safety device is in the safety position, i.e. when the levers 4 and 5 are in the high position, and the push pin 10 is advanced, the boring 18 is aligned with the groove 19. In this way, the insertion of the padlock 20 is possible to secure the firearm, by the introduction of the ring of this padlock 20 in the boring 18.

The safety mechanism of the present invention has the following advantages:

no irreversible modification practiced on the firearm which allows easy return to the original or conventional firearm;

visual and tactile indexing of the firearm in respective ready to shoot and safety positions;

adaptable to several models of a given firearm type (e.g. Glock 17 and other Glock pistol models);

easy ambidextrous handling of the weapon;

safety active during shelf storage.

The invention claimed is:

1. A removable manual and tactical safety device (1) for a hammerless or linear striker fired firearm having a frame, a slide (17) with a slide cover plate (22), a trigger mechanism comprising a trigger (15), a trigger bar (15A) attached to the trigger (15) and engaging by the intermediate of a connector (23) the rear portion of a firing pin (16) to prevent the firing pin (16) from moving forward, the trigger bar (15A) being also capable by going down to release the firing pin (16) for firing, when the trigger is pulled rearward, said safety device (1) being intended to be attached at the rear of the slide (17) and comprising a cylindrical body (2) having a longitudinal recess (3), a first lever (4) and a second lever (5) being secured together according to the axis of said longitudinal recess (3), said cylindrical body (2) having a transverse housing (9) for lodging a push pin (10) comprising a cogwheel having at least two cut cogs (14A) defining at least a first position and a second position of the push pin (10) respectively, said first lever (4) having a body (6) provided on its external surface with at least two pinions teeth (14B) capable of cooperating with the cut cogs (14A), so that the rotating of the first lever (4) secured with the second lever (5) permits the displacement of the push pin (10) perpendicularly to the axis of the longitudinal recess (3), said push pin (10) being held in said first and second position respectively by a spring (11) cooperating with a pin (12) located in a longitudinal cavity (13) of the cylindrical body (2) parallel to the axis of the longitudinal recess (3), said spring (11) maintaining a tip of said pin (12) within one of two recesses (30) provided on the side of said push pin (10), said push pin (10) further having a protrusion (10A) designed so that, in use, the forward, backward respectively, displacement of the push pin (10), defining an advanced and retracted position of the push pin (10) respectively, permits to prevent, allow respectively, the connector (23) of the firearm trigger bar (15A) to release the firing pin (16) for firing.

2. The safety device (1) according to claim 1, wherein the two recesses (30) are conical, pyramidal, spherical or in the shape of a truncated cone.

3. The safety device (1) according to claim 1, wherein the transverse housing (9) for lodging the push pin (10) and the push pin (10) are designed so that, when the push pin (10) is in the advanced position, the end of the push pin (10) distal of the protrusion (10A) does not protrude at the rear of the cylindrical body (2) and, when the push pin (10) is in the retracted position, the end of the push pin (10) distal of the protrusion (10A) protrudes at the rear of the cylindrical body (2).

4. The safety device (1) according to claim 3, wherein the position of the levers (4, 5) and of the push pin (10) notify the user if the safety device is in a so-called "safety position", the levers (4, 5) being up and the push pin (10) not protruding at the rear of the cylindrical body (2) or a so-called "ready to shoot" position, the levers (4, 5) being down and the push pin (10) protruding at the rear of the cylindrical body (2).

5. The safety device (1) according to claim 1, wherein the first lever (4) and the second lever (5) are secured by clicking together in the longitudinal recess (3) due to teeth (7) provided in the body (6) of the first lever (4) each suitable to cooperate with a slot (24) provided in the body (8) of the second lever (5).

6. The safety device (1) according to claim 5, wherein the displacement of the first lever (4) is able to cause the displacement of the second lever (5).

7. The safety device (1) according to claim 1, wherein the push pin (10) further comprises a groove (19) at the end opposite the protrusion (10A) and wherein the cylindrical body (2) comprises a longitudinal boring (18) parallel to the longitudinal recess (3), and traversing the transverse housing (9), so that a padlock (20) can be secured in said boring (18) when the push pin (10) is located with the groove (19) aligned to the boring (18), in safe position of the firearm.

8. The safety device (1) according to claim 1, further comprising fastening means (21) for attaching the safety device (1) in a sliding manner at the rear of the slide (17), after having removed the slide cover plate (22) at the rear of the slide (17).

9. The safety device (1) according to claim 1, intended to be placed on a firearm of the Glock type and which can be factory-assembled on said firearm or adapted to a firearm already in service.

10. Firearm of the Glock type comprising a removable safety device (1) according to claim 1.

11. The firearm according to claim 10, wherein, when the safety device (1) is located on the firearm in the safety position, the connector (23) of the trigger bar (15A) is pushed inwardly towards the slide axis by the protrusion (10A) of the push pin (10) which is in an advanced position, the connector (23) being prevented in this position to contact the trigger bar (15A) and further to unlock the latter for releasing the firing pin (16), when the trigger is pressed by the user.

12. The firearm according to claim 10, wherein, when the safety device (1) is located on the firearm in the ready to shoot position or in the firing position, the protrusion (10A) of the push pin (10) is in a retracted rearward position, the connector (23) being not prevented to contact the trigger bar (15A) and further to unlock the latter for releasing the firing pin (16), when the trigger is pressed by the user.

* * * * *